US007542002B1

(12) United States Patent
Andersson

(10) Patent No.: US 7,542,002 B1
(45) Date of Patent: Jun. 2, 2009

(54) WIDEBAND MONOPOLE ANTENNA

(75) Inventor: Johan Andersson, Malmö (SE)

(73) Assignee: Sony Ericsson Mobile Communications, AB, Lund (SE)

( * ) Notice: Subject to any disclaimer, the term of this patent is extended or adjusted under 35 U.S.C. 154(b) by 0 days.

(21) Appl. No.: 12/015,635

(22) Filed: Jan. 17, 2008

(51) Int. Cl.
*H01Q 9/28* (2006.01)

(52) U.S. Cl. ..... 343/795; 343/702; 343/700 MS

(58) Field of Classification Search ..... 343/702, 343/700 MS, 795
See application file for complete search history.

(56) References Cited

U.S. PATENT DOCUMENTS 6,661,380 B1 * 12/2003 Bancroft et al. ..... 343/700 MS
7,071,875 B2 * 7/2006 Sugimoto et al. ..... 343/700 MS
2008/0024366 A1 * 1/2008 Cheng ..... 343/700 MS

* cited by examiner

*Primary Examiner*—James Cho
(74) *Attorney, Agent, or Firm*—Harrity & Harrity, LLP

(57) ABSTRACT

A wideband monopole antenna arrangement, for a portable communication device, includes a substantially continuous conductor plate that includes a first antenna element and a second antenna element, and a signal ground arranged to interact with the antenna elements so as to form the wideband monopole antenna arrangement. The first antenna element extends substantially at an angle (θ) with respect to the second antenna element. The angle (θ) forms an acute angle of a right-angled triangle (T) in which the first antenna element extends substantially parallel to a hypotenuse (h) of the triangle (T) and the second antenna element extends substantially in parallel to a longer cathetus (c1) of two catheti (c1, c2) in the triangle (T).

30 Claims, 8 Drawing Sheets

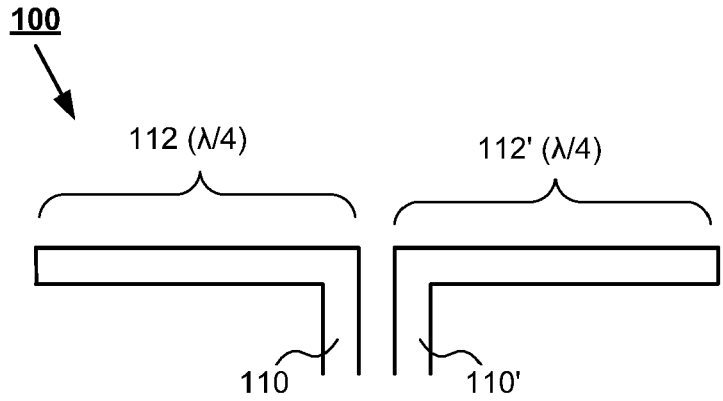
Fig. 1 – Related Art
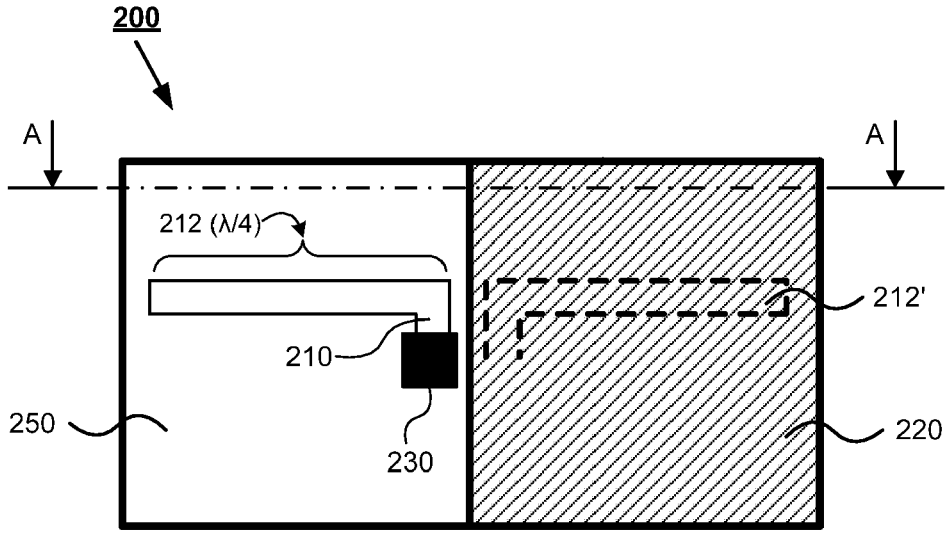
Fig. 2a – Related Art
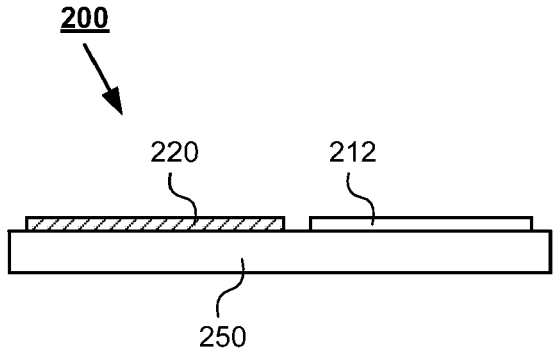
Fig. 2b – Related Art

WIDEBAND MONOPOLE ANTENNA

TECHNICAL FIELD

The present invention relates to the field of monopole antennas. Embodiments of the invention relate to monopole antennas for operating at multiple frequency bands. Other embodiments relate to portable radio devices comprising such antennas.

BACKGROUND

Within the field of portable radio devices there is commonly a need to make these devices operational at several frequency bands. Typically, portable radio devices are small and usually there is a limited space for providing this operational capacity.

The antenna arrangement in particular has turned out to be a crucial factor. Basically, different frequency bands require separate antennas which may not fit in the limited space of a portable device. Therefore, a single wideband antenna has frequently been used in portable radio devices.

However, it is a difficult task to design a single antenna small enough to fit in a portable device and efficient enough to provide a high performance over several different frequency bands. One approach has been to utilize the fundamental principles of a so-called monopole. As is well known, a monopole is basically a half dipole.

A typical dipole antenna 100 is schematically illustrated in FIG. 1. The typical dipole antenna 100 includes two feed lines 110, 110'. An end portion of each feed line 110, 110' is bent in a substantially perpendicularly direction with respect to feed line 110, 110' so as to form two antenna elements 112, 112'. A length of each antenna element 112, 112' is approximately one-quarter of the wavelength at the resonant frequency $f_0$ (e.g., $\lambda/4$, where $\lambda$ is the wavelength of the resonant frequency $f_0$). In other words, a total length of the antenna elements 112, 112' is about one half of the wavelength at the resonant frequency $f_0$ (e.g., $\lambda/2$). Dipole antenna 100 is typically operated at a single frequency $f_0$.

To make the conventional dipole antenna more compact, a simplification of the antenna can be formed on a suitable substrate arrangement (e.g., a circuit board or a similar device). This is schematically illustrated in FIG. 2*a* and in FIG. 2*b*. FIG. 2*a* presents a top view a monopole antenna 200, and FIG. 2*b* presents a cross-section of monopole antenna 200 in FIG. 2*a*, as seen in a direction indicated by the arrows A-A.

Monopole antenna arrangement 200 in FIGS. 2*a* and 2*b* includes a substrate 250 (preferably a dielectric substrate), an electrically conductive patch line 210 (preferably a metallic patch line), and a ground metal plate (or ground plane) 220 formed on a top surface of dielectric substrate 250 at the same side as patch line 210. Alternatively, ground plane 220 may be formed on a bottom surface of the dielectric substrate 250, or in dielectric substrate 250. One end of patch line 210 is formed as a signal feed point 230, whereas another end of patch line 210 is formed as an antenna element 212 having an L-shape so that antenna element 212 extends from ground plane 220 in a direction substantially perpendicular to patch line 210. Monopole antenna arrangement 200 is formed by antenna element 212 interacting with ground plane 220.

Monopole antenna arrangement 200 takes advantage of ground plane 220 and well known image theory to map patch line 210 and the inverted L-shaped antenna element 212 so as to form a fictive second antenna element 212', as indicated by dashed lines in FIG. 2*a*. As a result, monopole antenna arrangement 200 having antenna elements 212, 212' substantially equivalent to antenna elements 112, 112' of dipole antenna arrangement 100 is formed. Monopole antenna arrangement 200 is typically operated at a single frequency.

Even if the fundamental principles of monopoles may be used to accomplish an antenna that is smaller than a full dipole antenna, it is still only suitable to operate in one frequency band.

SUMMARY OF THE INVENTION

Embodiments described herein may be directed to solving the problem of providing a small monopole antenna arrangement with a high performance over several different frequency bands. In addition, embodiments described herein may be directed to a portable radio device that may include a small monopole antenna arrangement that provides a high performance over several different frequency bands. The small monopole antenna thus overcomes the difficulties of designing small and efficient wideband antenna arrangements.

According to one embodiment, a wideband monopole antenna arrangement, for a portable communication device, may include a substantially continuous conductor plate that includes a first antenna element and a second antenna element, and a signal ground arranged to interact with the antenna elements so as to form the wideband monopole antenna arrangement. The first antenna element may extend substantially at an angle ($\theta$) with respect to the second antenna element. The angle ($\theta$) may form an acute angle of a right-angled triangle (T) in which the first antenna element extends substantially parallel to a hypotenuse (h) of the triangle (T) and the second antenna element extends substantially in parallel to a longer cathetus (c1) of two catheti (c1, c2) in the triangle (T).

Additionally, at least one long-side of the first antenna element may include a stair-like shape.

Additionally, a connecting part of the first antenna element may elongate the first antenna element and the second antenna element by extending between an end of the first antenna element adjacent to the angle ($\theta$) and an end of the second antenna element adjacent to the angle ($\theta$).

Additionally, the connecting part may extend in a direction substantially perpendicular to the second antenna element.

Additionally, a first extension part of the second antenna element may elongate the second antenna element by extending from an end of the second antenna element that is spaced from the angle ($\theta$).

Additionally, the first extension part may extend towards the first antenna element at an end that is spaced from the angle ($\theta$).

Additionally, the first extension part may extend in a direction substantially perpendicular to the second antenna element.

Additionally, a second extension part may elongate the second antenna element by extending from an end of the first extension part that is spaced from the first antenna element.

Additionally, the second extension element may extend towards the second antenna element at an end that is close to the angle ($\theta$).

Additionally, the second extension element may extend in a direction substantially parallel to the second antenna element.

Additionally, the first antenna element may be longer than the second antenna element, and may radiate in a lower operating band or bands of the wideband monopole antenna arrangement, and the second antenna element may radiate in an upper operating band or bands of the wideband monopole antenna arrangement.

Additionally, the second antenna element may be longer than the first antenna element, and may radiate in a lower operating band or bands of the wideband monopole antenna arrangement, and the first antenna element may radiate in an upper operating band or bands of the wideband monopole antenna arrangement.

Additionally, the wideband monopole antenna arrangement may include a feed conductor, and a feed point, arranged near an end of the second antenna element that is close to the angle (θ), for connecting the feed conductor to the antenna elements.

Additionally, the feed point may include a matching network for maximizing a power transfer from the feed conductor to the antenna elements.

Additionally, the matching network may include a PI-shaped network that includes a first component (Z1), a second component (Z2), and a third component (Z3).

Additionally, the first component (Z1) may connect between a feed line and the conductor plate, the second component (Z2) may connect between the feed line and the signal ground, and the third component (Z3) may connect between the conductor plate and the signal ground.

Additionally, the first component (Z1) may include a capacitance of approximately five picofarad, the second component (Z2) may include a capacitance of approximately one picofarad, and the third component (Z3) may include an inductance of approximately nine nanohenry.

According to another embodiment, a portable communication device may include a wideband monopole antenna arrangement that includes a substantially continuous conductor plate with a first antenna element and a second antenna element, and a signal ground configured to interact with the antenna elements so as to form the wideband monopole antenna arrangement. The first antenna element may extend substantially at an angle (θ) with respect to the second antenna element. The angle (θ) may form an acute angle of a right-angled triangle (T) in which the first antenna element extends substantially parallel to a hypotenuse (h) of the triangle (T) and the second antenna element extends substantially parallel to a longer cathetus (c1) of two catheti (c1, c2) in the triangle (T).

Additionally, at least one long-side of the first antenna element may include a stair-like shape.

Additionally, a connecting part of the first antenna element may elongate the first antenna element and the second antenna element by extending between an end of the first antenna element adjacent to the angle (θ) and an end of the second antenna element adjacent to the angle (θ).

Additionally, the connecting part may extend in a direction substantially perpendicular to the second antenna element.

Additionally, a first extension part of the second antenna element may elongate the second antenna element by extending from an end of the second antenna element that is spaced from the angle (θ).

Additionally, the first extension part may extend towards the first antenna element at an end that is spaced from the angle (θ).

Additionally, the first extension part may extend in a direction substantially perpendicular to the second antenna element.

Additionally, a second extension part may elongate the second antenna element by extending from an end of the first extension part that is spaced from the first antenna element.

Additionally, the second extension element may extend towards the second antenna element at an end that is close to the angle (θ).

Additionally, the second extension element may extend in a direction substantially parallel to the second antenna element.

Additionally, the first antenna element may be longer than the second antenna element, and may radiate in a lower operating band or bands of the wideband monopole antenna arrangement, and the second antenna element may radiate in an upper operating band or bands of the wideband monopole antenna arrangement.

Additionally, the second antenna element may be longer than the first antenna element, and may radiate in a lower operating band or bands of the wideband monopole antenna arrangement, and the first antenna element may radiate in an upper operating band or bands of the wideband monopole antenna arrangement.

Additionally, the wideband monopole antenna arrangement may include a feed conductor, and a feed point, arranged near an end of the second antenna element that is close to the angle (θ), for connecting the feed conductor to the antenna elements.

Additionally, the feed point may include a matching network for maximizing a power transfer from the feed conductor to the antenna elements.

Additionally, the matching network may include a PI-shaped network that includes a first component (Z1), a second component (Z2), and a third component (Z3).

Additionally, the first component (Z1) may connect between a feed line and the conductor plate, the second component (Z2) may connect between the feed line and the signal ground, and the third component (Z3) may connect between the conductor plate and the signal ground.

Additionally, the first component (Z1) may include a capacitance of approximately five picofarad, the second component (Z2) may include a capacitance of approximately one picofarad, and the third component (Z3) may include an inductance of approximately nine nanohenry.

BRIEF DESCRIPTION OF THE DRAWINGS

The accompanying drawings, which are incorporated in and constitute a part of this specification, illustrate one or more embodiments described herein and, together with the description, explain these implementations. In the drawings:

FIG. 1 is a schematic illustration of a typical dipole antenna arrangement;

FIG. 2*a* is a top view schematic illustration of a monopole antenna arrangement;

FIG. 2*b* is a schematic illustration of a cross-section of the antenna arrangement depicted in FIG. 2*a*, as seen in the direction indicated by the arrows A-A;

DETAILED DESCRIPTION

Embodiments described herein relate to a wideband antenna for portable communication devices, and to portable communication devices that include such antennas. However, the present invention is not limited to wideband antennas for portable communication devices or to portable communication devices that include such antennas. Rather, the present invention can be applied to any suitable portable radio device.

Figure 3:
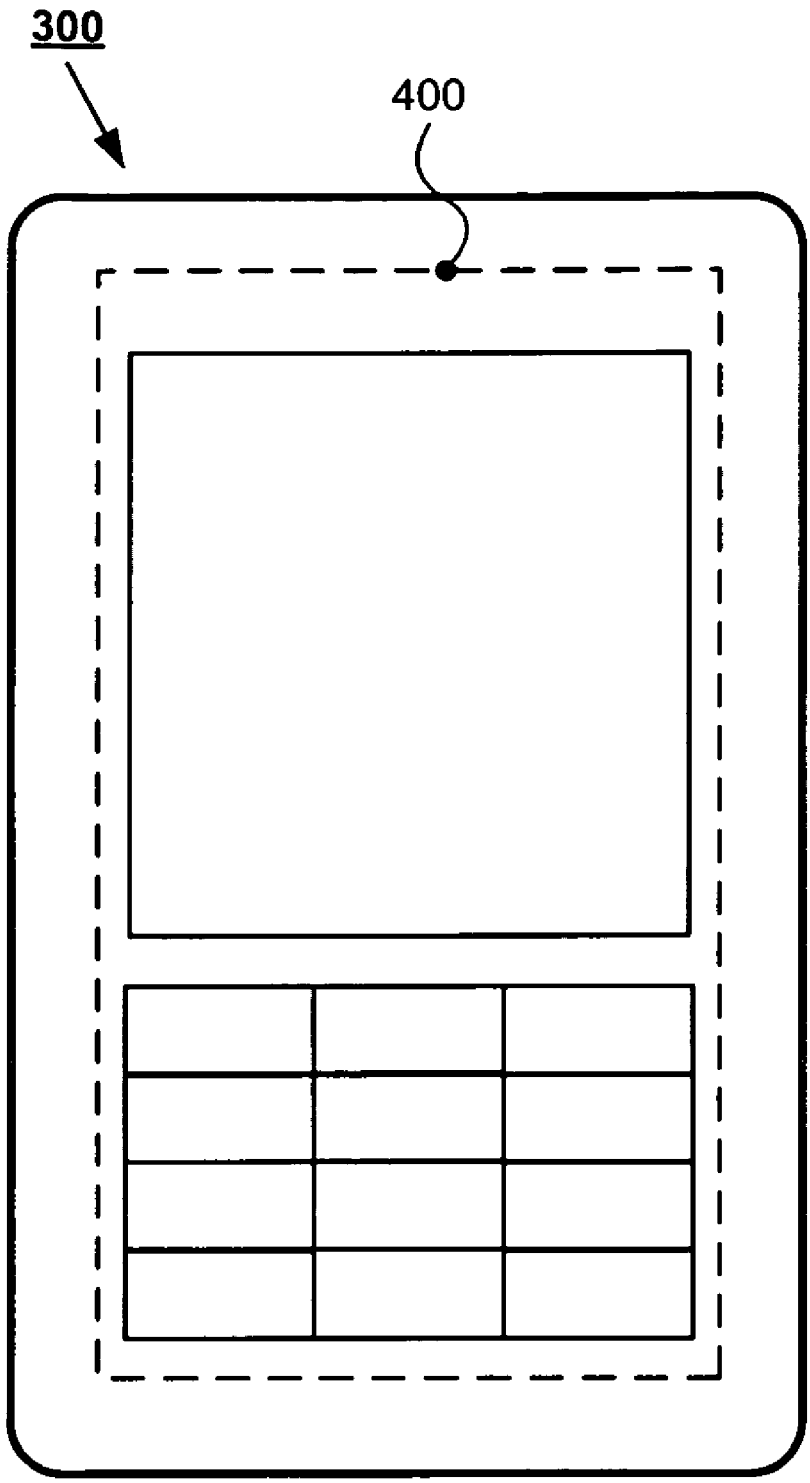
FIG. 3 is a schematic illustration of an exemplary portable communication device and a wideband monopole antenna arrangement according to an embodiment described herein.

FIG. 3 is a schematic illustration of an exemplary portable communication device 300 that may include a wideband monopole antenna arrangement 400 according to an embodiment described herein. Antenna arrangement 400 may be arranged within device 300 and is indicated in FIG. 3 by a rectangle with dashed lines. In one embodiment, device 300 may include a cell phone arranged to operate on a plurality of frequency bands, e.g., a plurality of frequency bands within a range of approximately 850 MHz to approximately 2400 MHz.

For example, cell phones according to the Global System for Mobile communications (GSM) may be operational on three different frequency bands (e.g., 900/1800/1900 MHz or 850/1800/1900 MHz). Similarly, cell phones according to the Universal Mobile Telecommunication System (UMTS) may operate on one or several frequency bands within a range of approximately 800-2600 MHz. Moreover, cell phones and similar radio devices may have the ability to operate both as a GSM phone and as a UMTS phone. Moreover, modern cell phones may have the ability to communicate with other networks in addition to one or several cellular telecommunication networks (e.g., in addition to GSM and/or UMTS). Modern cell phones may, e.g., have the additional capability to communicate on the 2400 MHz band with Bluetooth devices and/or WiFi devices and/or with similar radio devices on other frequency bands. The frequency bands and the general radio properties of GSM devices, UMTS devices, Bluetooth devices and WiFi devices, etc. are well known.

Figure 4:
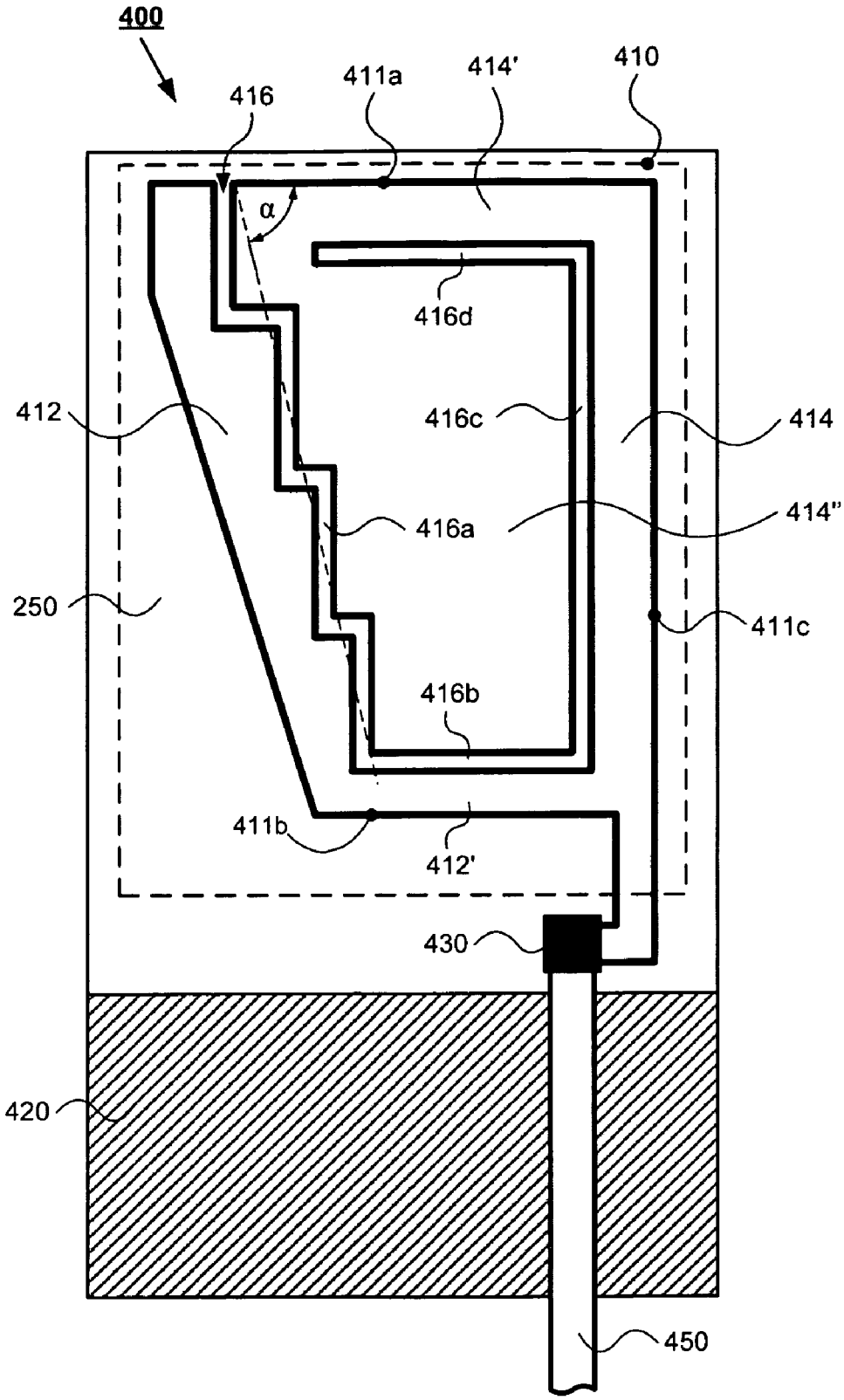
FIG. 4 is a schematic illustration showing relevant details of the antenna arrangement in the exemplary portable communication device depicted in FIG. 3.

FIG. 4 is a schematic illustration showing relevant details of antenna arrangement 400 in exemplary portable communication device 300. Antenna arrangement 400 may include a monopole antenna arrangement that fits within device 300 and may provide a high performance within a range of approximately 850 MHz to approximately 2400 MHz.

As will be further described below, antenna arrangement 400 may include a principally rectangular and substantially continuous conductor plate 410 enclosed by a rectangle with dashed lines in FIG. 4. Moreover, antenna arrangement 400 may include a substantially continuous signal ground 420 and a feed point 430.

Signal ground 420 may be arranged at a predetermined distance from a lower short-end 411*b* of the principally rectangular conductor plate 410 so that conductor plate 410 and its antenna elements 412, 414 can interact with signal ground 420 to form a wideband monopole antenna, as will be further described later. The properties of signal ground 420 may be less relevant to embodiments of the invention as long as well known image theory can be utilized to map antenna elements 412, 414 so as to form a monopole antenna arrangement (e.g., in the same or similar manner as previously indicated for fictive antenna element 212' in FIG. 2*a*). Signal ground 420 may be formed on the upper surface of a substrate 250 (e.g., a dielectric substrate) in the same or similar manner, as shown in FIG. 2*b*, that ground metal plate 220 is formed on substrate 250.

Feed point 430 of antenna arrangement 400 may be arranged approximately at the lower right corner of the principally rectangular conductor plate 410. Feed point 430 may be adapted to connect conductor plate 410 to a feed conductor 450. Feed conductor 450 may be any suitable waveguide for guiding microwaves to feed point 430 (e.g., such as a coaxial cable, a microstrip transmission line, or similar mechanism). In one embodiment, feed point 430 may be formed on the upper surface of substrate 250.

In other embodiments, signal ground 420 and possibly feed point 430 may, alternatively, be formed at a lower surface of substrate 250, or possibly within substrate 250.

In one embodiment, conductor plate 410 may be formed on the surface of the substrate 250 (e.g., in a same or similar manner, as shown in FIG. 2*b*, that antenna element 212 is formed on substrate 250). Alternatively, conductor plate 410 may be formed at the lower surface of substrate 250 or within substrate 250. Embodiments of conductor plate 410 may be formed by a rigid and self-supporting conductive sheet (e.g., a metal sheet). In such embodiments, portions of conductor plate 410 may be formed on substrate 250, whereas the remaining portions of conductor plate 410 may be self-supporting.

As described above, conductor plate 410 may include first antenna element 412 and second antenna element 414. Antenna elements 412, 414 may generally be formed by a slot 416 that includes a plurality of branches.

A first branch 416*a* of slot 416 may begin at an end approximately at an upper left corner of the substantially rectangular conductor plate 410. From there first branch 416*a* may extend towards feed point 430 to an end adjacent to feed point 430 along a stepped pattern and principally at an angle $\alpha$ with respect to an upper short-end 411*a* of the substantially rectangular conductor plate 410. First branch 416*a* of slot 416 may end approximately at a lower short-end 411*b* of the substantially rectangular conductor plate 410.

In this manner, first branch 416*a* of slot 416 may delimit a part of conductor plate 410 that extends from an end distant or spaced from feeding point 430 to an end close to feeding point 430 and substantially at the angle $\alpha$ with respect to lower short-end 411*b* of conductor plate 410. Lower short-end 411*b* may be substantially parallel to upper short-end 411*a*. This part forms the main part of an oblique first antenna element 412 of antenna arrangement 400 extending from feed point 430 at an angle $\alpha$ less than 90° with respect to lower short-end 411*b* of conductor plate 410 (equivalent to an angle $\beta$==180°−$\alpha$ that may be more than 90° with respect to lower short-end 411*b*).

A second branch 416*b* of slot 416 may extend from the end of first branch 416*a* in a direction towards feed point 430 and a long-side 411*c* of conductor plate 410, and substantially parallel to lower short-end 411*b*. Second branch 416*b* of slot 416 may end approximately at long-side 411*c*. Second branch 416*b* may delimit a connecting part 412' of conductor plate 410. Connecting part 412' may extend from the end of first antenna element 412 that is closest to feeding point 430 and substantially parallel to the upper and lower short ends 411*a*, 411*b*. Connecting part 412' may form a substantially horizontal part of first oblique antenna element 412.

A third branch 416*c* of slot 416 may extend from the end of second branch 416*b* in a direction from feed point 430 and substantially parallel to long-side 411*c*, in turn being substantially perpendicular to the upper and lower short-ends 411*a*, 411*b*. Third branch 416*c* of the slot 416 may end approximately at upper short-end 411*a*. Third branch 416*c* may delimit a part of conductor plate 410 that extends from an end close to feeding point 430 to an end distant from feeding point 430 and in a direction substantially perpendicular to the upper and lower short ends 411*a*, 411*b*. This part may form the main part of the substantially straight and vertical second antenna element 414 of antenna arrangement 400.

A fourth branch 416*d* of slot 416 may extend from the end of third branch 416*c* in a direction from long-side 411*c* and substantially parallel to the upper and lower short ends 411*a*, 411*b*. Fourth branch 416*d* of slot 416 may end approximately at first branch 416*a* of slot 416.

Fourth branch 416*d* may delimit an extension part of conductor plate 410 that extends from the end of second antenna element 414 that is distant from feed point 430 and towards first antenna element 412 in a direction substantially parallel to the upper and lower short ends 411*a*, 411*b*. Extension part 414' may form a substantially horizontal part of the second vertical antenna element 414.

In addition, first branch 416*a*, second branch 416*b* and third branch 416*c* of slot 416 may delimit a second extension part 414" of conductor plate 410 that extends from the end of first extension part 414' that is distant from second antenna element 414 and towards connection part 412' in a direction substantially perpendicular to the upper and lower short ends 411*a*, 411*b*. Second extension part 414" may form an additional substantially vertical part of the second vertical antenna element 414.

Figure 5:
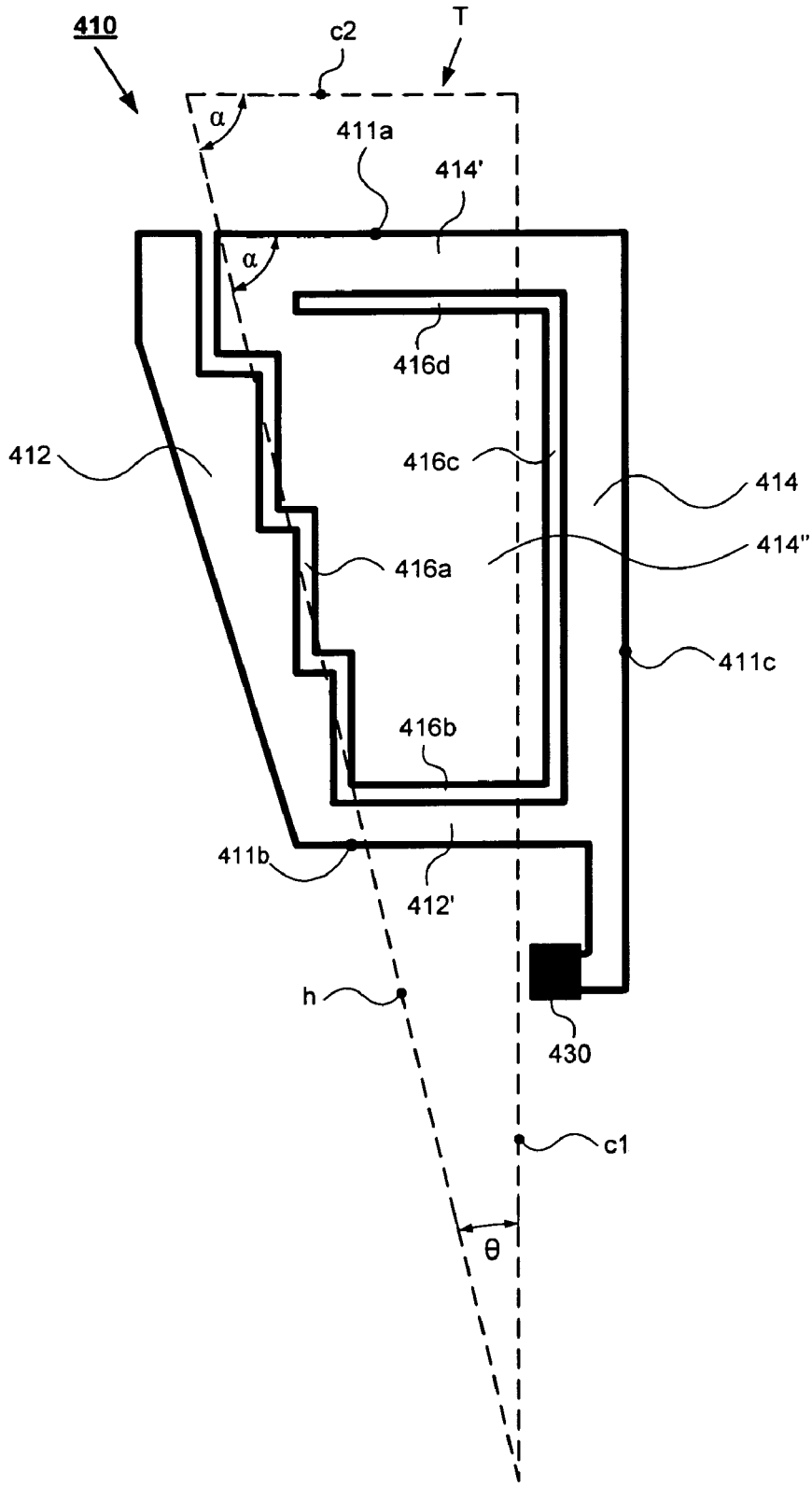
FIG. 5 is a diagram illustrating a conductor plate and antenna elements of the antenna arrangement depicted in FIG. 4 in relation to a right-angled triangle T.

Thus, the first oblique antenna element 412 may extend substantially at an angle $\theta=90°-\alpha$ with respect to second antenna element 414. As schematically illustrated in FIG. 5, the angle $\theta$ between first oblique antenna element 412 and second vertical antenna element 414 may form the acute angle in a right-angled triangle T indicated by dashed lines in FIG. 5. In the triangle T, first oblique antenna element 412 may extend parallel to the hypotenuse h in the triangle T and second vertical antenna element 414 may extend from feed point 430 and parallel to the longer cathetus c1 of the two catheti c1, c2 in the triangle T.

Connecting part 412' connecting first antenna element 412 and second antenna element 414 may extend between the end of first antenna element 412 that is adjacent or close to feeding point 430, and the end of second antenna element 414 that is close to feeding point 430. In other words, connecting part 412' may extend between the end of first antenna element 412 that is close to the acute angle $\theta$, and the end of second antenna element 414 that is close to the acute angle $\theta$.

Moreover, first extension part 414' extending second antenna element 414 may extend from the end of second antenna element 414 that is spaced or distant from feeding point 430 towards first antenna element 412 and in a direction that is substantially perpendicular to second antenna element 414.

Second extension part 414" extending second antenna element 414 may extend from the end of first extension part 414' that is distant from first antenna element 414 towards connecting part 412' and in a direction that is substantially parallel to second antenna element 414.

Oblique first antenna element 412 may be longer than second vertical antenna element 414 with the effect that the longer first antenna element 412 may be dimensioned so as to radiate in lower operating band or bands of antenna arrangement 400, and the shorter second antenna element 414 may be dimensioned so as to radiate in upper operating band or bands of antenna arrangement 400. This may be particularly so if connecting part 412' is considered to be a part of the first antenna element 412.

However, second vertical antenna element 414 may be longer than the first oblique antenna element 414 with the effect that the longer second antenna element 414 may be dimensioned so as to radiate in the lower operating band or bands of antenna arrangement 400, and the shorter first antenna element 412 may be dimensioned so as to radiate in the upper operating band or bands of antenna arrangement 400. This may be particularly so if first extension part 414' is considered to be a part of second antenna element 414, and this may be even more so if second extension part 414" is also considered to be a part of second antenna element 414.

Exemplary dimensions of the substantially rectangular conductor plate 410 may be approximately 40 millimeters by 60 millimeters. The oblique first antenna element 412 may be approximately 50 millimeters long, and the second vertical antenna element 414 may be approximately 40 millimeters long. Connecting part 412' may be approximately 20 millimeters long, and extension part 414' may be approximately 25 millimeters long. The angle $\theta$ may be approximately 20°. In other embodiments, other dimensions are conceivable, particularly dimensions that deviate from the given exemplary dimensions by less than +/−10%.

Figure 6:
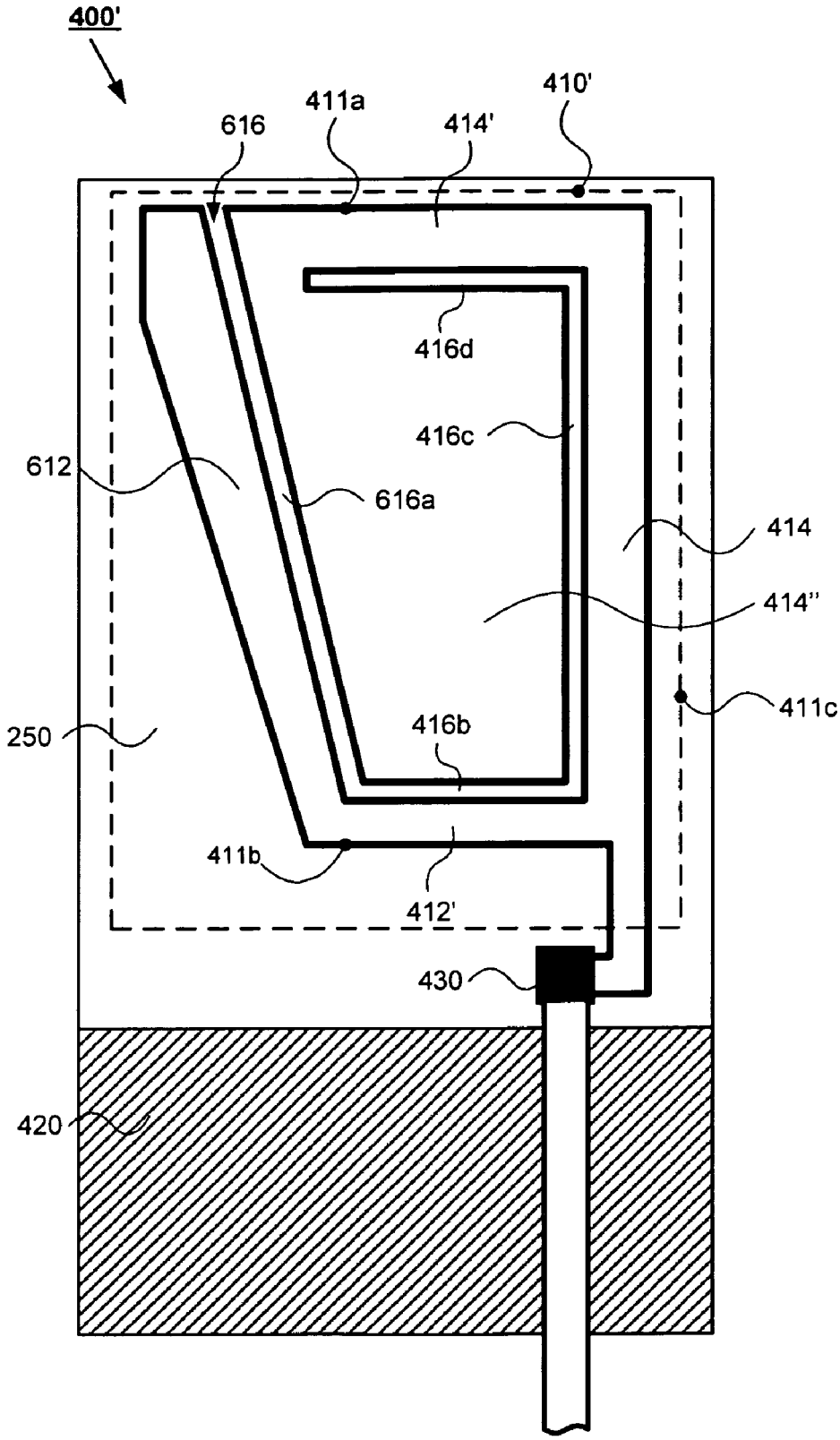
FIG. 6 is a schematic illustration showing details of a monopole antenna arrangement according to another embodiment described herein.

FIG. 6 is a schematic illustration showing relevant details of a monopole antenna arrangement 400' according to another embodiment described herein. As illustrated, antenna arrangement 400' may include a conductor plate 410' substantially similar to the previously described conductor plate 410. However, a first branch 616*a* of a slot 616 in FIG. 6 may extend along a straight line instead of the stepped or stair-like pattern of FIG. 5, along which first branch 416*a* of slot 416 of the conductor plate 410 extends. Hence, a first antenna element 612 of conductor plate 410' may include a substantially straight shape compared to first antenna element 412 of conductor plate 410 which may include one long side that displays a stair-like (i.e., a stepped) shape.

Figure 7:
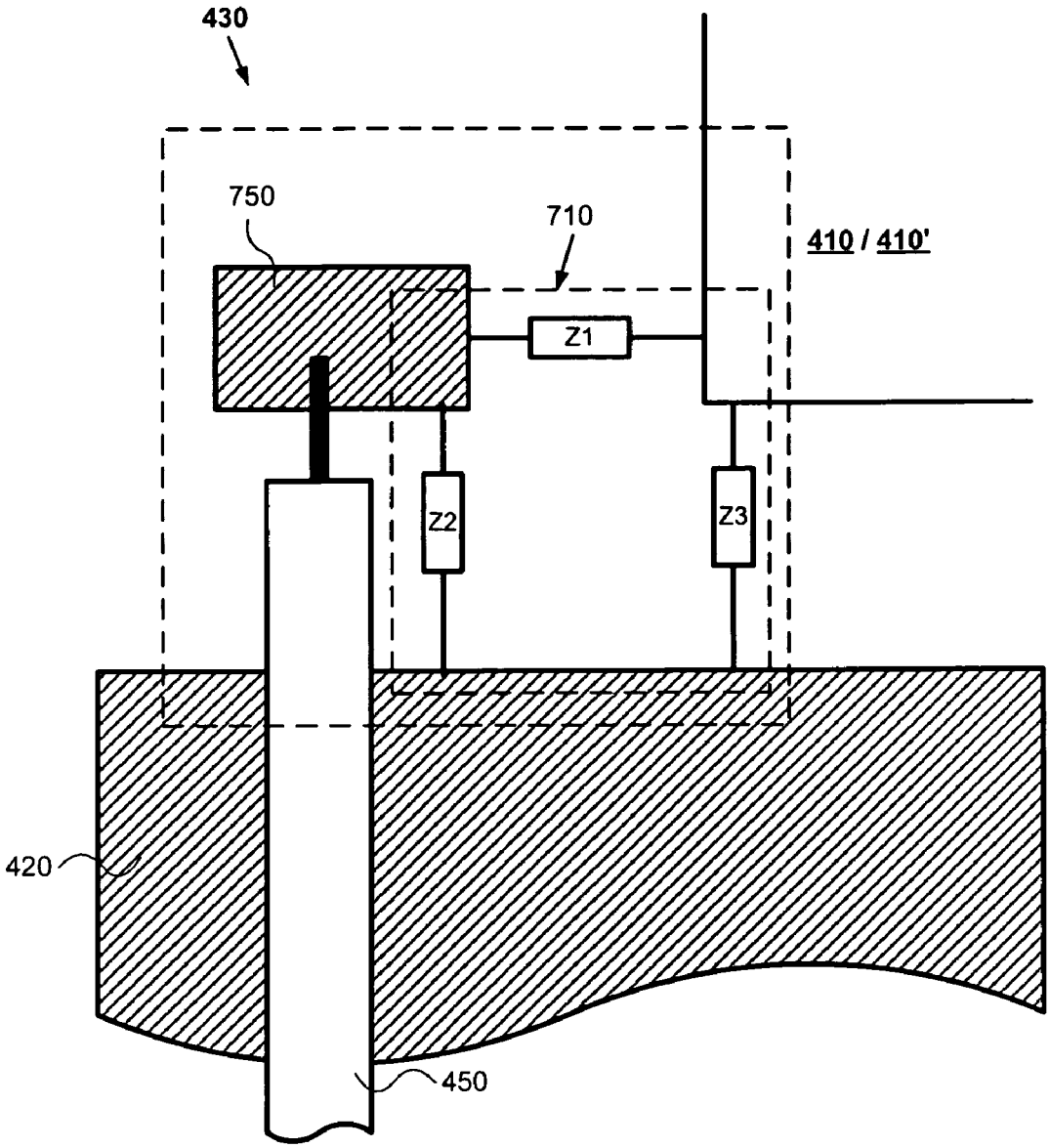
FIG. 7 is a schematic illustration of a feed point, with a matching network, of the antenna arrangement depicted in FIG. 4.

FIG. 7 is a schematic illustration of feed point 430 that may be adapted to connect conductor plate 410 or 410' and antenna elements 412, 414, 612 to a feed conductor 450, as previously indicated. Feed point 430 may include a metal plate 750 or a similar mounting patch for connecting feed conductor 450 (e.g., by means of soldering, bonding, or other similar mechanism). Metal plate 750 may be "free floating" (i.e., metal plate 750 may not connect to other electrical components except those explicitly described herein).

In addition, feed point 430 may include a matching network 710. As can be seen in FIG. 7, matching network 710 may include a so-called PI-network that includes a first component Z1 connected between mounting patch 750 and conductor plate 410 or 410', a second component Z2 connected between mounting patch 750 and signal ground 420, and a third component Z3 connected between conductor plate 410 or 410' and signal ground 420. In this manner the components form a stylized PI (i.e., the Greece letter $\pi$). Matching network 710 may be arranged so as to maximize the power transfer from feed conductor 450 to conductor plate 410, 410' and antenna elements 412, 414, 612, as may be the case.

Exemplary values of components Z1, Z2 and Z3 for matching feed conductor 450 having a characteristic impedance of substantially 50 ohms may be substantially 5 pF for Z1, substantially 1 pF for Z2, and substantially 9 nH for Z3. Such values presuppose ideal components. However, commercially available components may include resistive losses and possibly other loses that should be kept at a minimum. In addition, the selection of a suitable matching network 710 and suitable values for the components in the selected matching network 710 may be necessary for an antenna arrangement.

Figure 8:
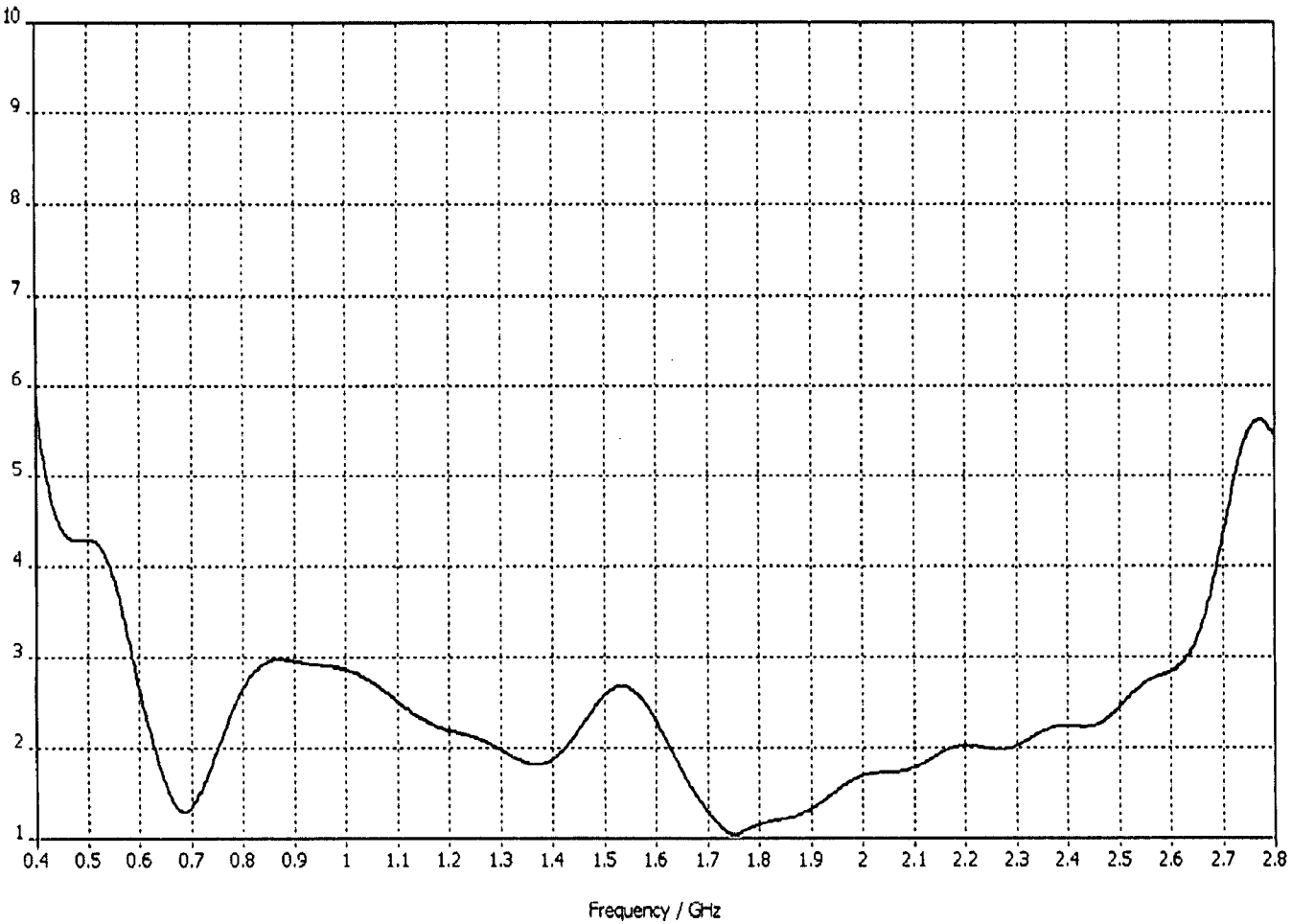
FIG. 8 is an exemplary graph showing a Voltage Standing Wave Ratio (VSWR) for the antenna arrangement depicted in FIG. 4.

FIG. 8 is an exemplary graph showing a Voltage Standing Wave Ratio (VSWR) for antenna arrangement 400. The horizontal x-axis may extend from 0.4 GHz to 2.8 GHz. The vertical y-axis may show the VSWR at a certain frequency within the above frequency span (0.4 to 2.8 GHz).

Figure 9:
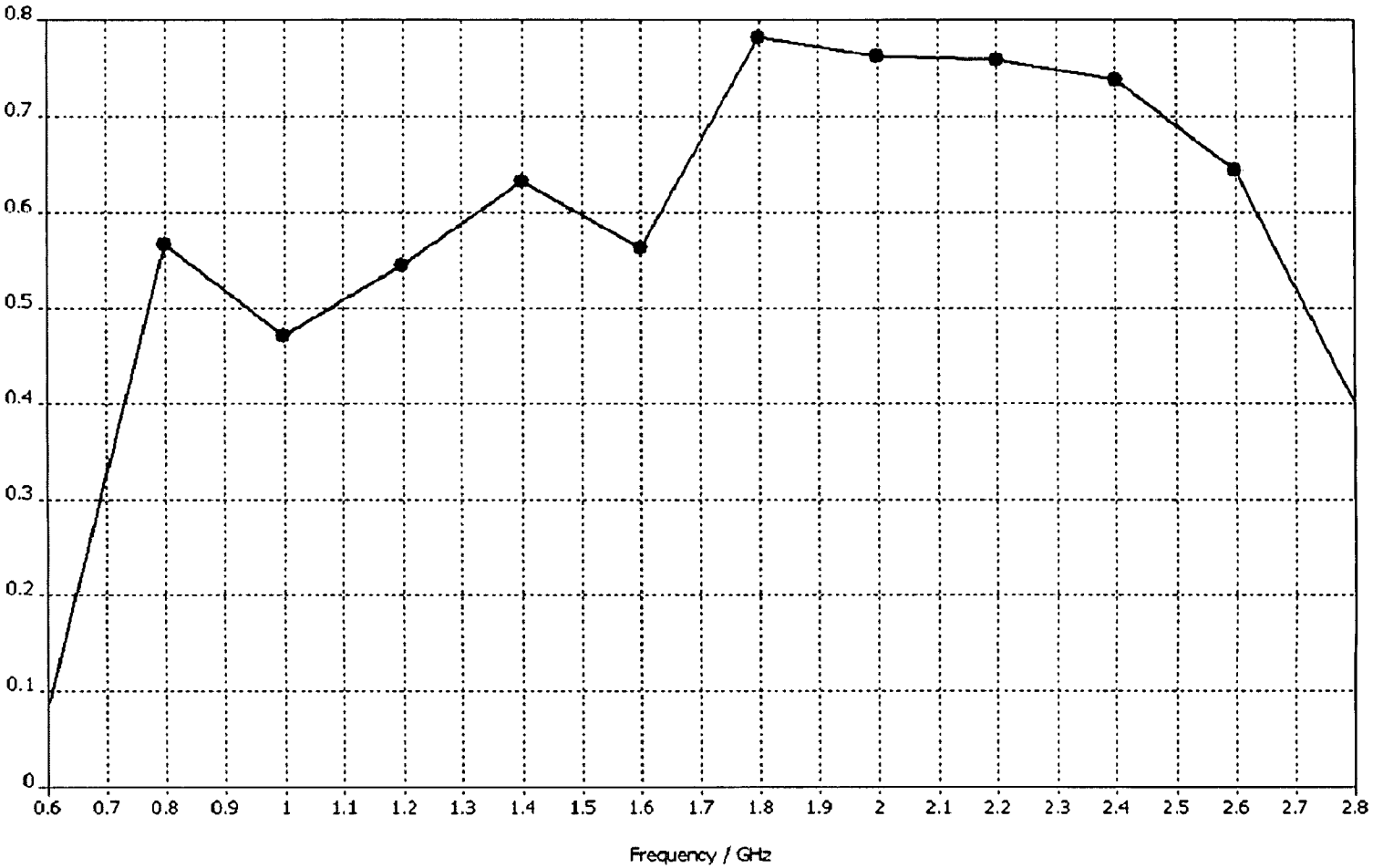
FIG. 9 is an exemplary graph showing a radiation efficiency for the antenna arrangement depicted in FIG. 4.

FIG. 9 is an exemplary graph showing radiation efficiency for antenna arrangement 400. The horizontal x-axis may extend from 0.6 GHz to 2.8 GHz. The vertical y-axis may show the radiation efficiency at a certain frequency within the above frequency span (0.6 to 2.8 GHz).

Embodiments described herein may provide an improved single antenna arrangement for a portable radio device. The antenna arrangement may provide excellent properties over a wide range of frequency bands at the same time as it is small enough to fit within the portable device.

The foregoing description of embodiments provides illustration and description, but is not intended to be exhaustive or to limit the invention to the precise form disclosed. Modifications and variations are possible in light of the above teachings or may be acquired from practice of the invention.

It should be emphasized that the term "comprises/comprising" when used in the this specification is taken to specify the presence of stated features, integers, steps or components but does not preclude the presence or addition of one or more other features, integers, steps, components or groups thereof.

Even though particular combinations of features are recited in the claims and/or disclosed in the specification, these combinations are not intended to limit the invention. In fact, many of these features may be combined in ways not specifically recited in the claims and/or disclosed in the specification.

No element, block, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A wideband monopole antenna arrangement for a portable communication device, comprising a substantially continuous conductor plate that includes a first antenna element and a second antenna element; and a signal ground arranged to interact with the antenna elements so as to form the wideband monopole antenna arrangement, where the first antenna element extends substantially at an angle (θ) with respect to the second antenna element, the angle (θ) forming an acute angle of a right-angled triangle (T) in which the first antenna element extends substantially parallel to a hypotenuse (h) of the triangle (T) and the second antenna element extends substantially in parallel to a longer cathetus (c1) of two catheti (c1, c2) in the triangle (T), and where the second antenna element includes:

a first extension part that elongates the second antenna element by extending from an end of the second antenna element that is spaced from the angle (θ), and a second extension part that elongates the second antenna element by extending from an end of the first extension part that is spaced from the first antenna element.

2. The wideband monopole antenna arrangement according to claim 1, where at least one long-side of the first antenna element comprises a stair-like shape.

3. The wideband monopole antenna arrangement according to claim 1, where a connecting part of the first antenna element elongates the first antenna element and the second antenna element by extending between an end of the first antenna element adjacent to the angle (θ) and an end of the second antenna element adjacent to the angle (θ).

4. The wideband monopole antenna arrangement according to claim 3, where the connecting part extends in a direction substantially perpendicular to the second antenna element.

5. The wideband monopole antenna arrangement according to claim 1, where the first extension part extends towards the first antenna element at an end that is spaced from the angle (θ).

6. The wideband monopole antenna arrangement according to claim 1, where the first extension part extends in a direction substantially perpendicular to the second antenna element.

7. The wideband monopole antenna arrangement according to claim 1, where the second extension part extends towards the second antenna element at an end that is close to the angle (θ).

8. The wideband monopole antenna arrangement according to claim 1, where the second extension part extends in a direction substantially parallel to the second antenna element.

9. The wideband monopole antenna arrangement according to claim 1, where:

the first antenna element is longer than the second antenna element, and radiates in a lower operating band or bands of the wideband monopole antenna arrangement; and the second antenna element radiates in an upper operating band or bands of the wideband monopole antenna arrangement.

10. The wideband monopole antenna arrangement according to claim 1, where:

the second antenna element and the first extension part together are longer than the first antenna element;

the second antenna element radiates in a lower operating band or bands of the wideband monopole antenna arrangement; and the first antenna element radiates in an upper operating band or bands of the wideband monopole antenna arrangement.

11. The wideband monopole antenna arrangement according to claim 1, further comprising:

a feed conductor; and a feed point, arranged near an end of the second antenna element that is close to the angle (θ), for connecting the feed conductor to the antenna elements.

12. The wideband monopole antenna arrangement according to claim 11, where the feed point comprises a matching network for maximizing a power transfer from the feed conductor to the antenna elements.

13. The wideband monopole antenna arrangement according to claim 12, where the matching network comprises a PI-shaped network that includes a first component (Z1), a second component (Z2), and a third component (Z3).

14. The wideband monopole antenna arrangement according to claim 13, where:

the first component (Z1) connects between a feed line and the conductor plate;

the second component (Z2) connects between the feed line and the signal ground; and the third component (Z3) connects between the conductor plate and the signal ground.

15. The wideband monopole antenna arrangement according to claim 14, where:

the first component (Z1) comprises a capacitance of approximately five picofarad;

the second component (Z2) comprises a capacitance of approximately one picofarad; and the third component (Z3) comprises an inductance of approximately nine nanohenry.

16. The portable communication device according to claim 1, where the second extension part extends towards the second antenna element at an end that is close to the angle (θ).

17. The portable communication device according to claim 1, where the second extension part extends in a direction substantially parallel to the second antenna element.

18. A portable communication device comprising:

a wideband monopole antenna arrangement that includes:

a substantially continuous conductor plate with a first antenna element and a second antenna element, and a signal ground configured to interact with the antenna elements so as to form the wideband monopole antenna arrangement, where the first antenna element extends substantially at an angle (θ) with respect to the second antenna element, the angle (θ) forming an acute angle of a right-angled triangle (T) in which the first antenna element extends substantially parallel to a hypotenuse (h) of the triangle (T) and the second antenna element extends substantially parallel to a longer cathetus (c1) of two catheti (c1, c2) in the triangle (T), and where the second antenna element includes:

a first extension part that elongates the second antenna element by extending from an end of the second antenna element that is spaced from the angle (θ), and a second extension part that elongates the second antenna element by extending from an end of the first extension part that is spaced from the first antenna element.

19. The portable communication device according to claim 18, where at least one long-side of the first antenna element comprises a stair-like shape.

20. The portable communication device according to claim 18, where a connecting part of the first antenna element elongates the first antenna element and the second antenna element by extending between an end of the first antenna element adjacent to the angle (θ) and an end of the second antenna element adjacent to the angle (θ).

21. The portable communication device according to claim 20, where the connecting part extends in a direction substantially perpendicular to the second antenna element.

22. The portable communication device according to claim 18, where the first extension part extends towards the first antenna element at an end that is spaced from the angle (θ).

23. The portable communication device according to claim 18, where the first extension part extends in a direction substantially perpendicular to the second antenna element.

24. The portable communication device according to claim 18, where:

the first antenna element is longer than the second antenna element, and radiates in a lower operating band or bands of the wideband monopole antenna arrangement; and the second antenna element radiates in an upper operating band or bands of the wideband monopole antenna arrangement.

25. The portable communication device according to claim 18, where:

the second antenna element and the first extension part together are longer than the first antenna element;

the second antenna element radiates in a lower operating band or bands of the wideband monopole antenna arrangement; and the first antenna element radiates in an upper operating band or bands of the wideband monopole antenna arrangement.

26. The portable communication device according to claim 18, where the wideband monopole antenna arrangement further includes:

a feed conductor; and a feed point, arranged near an end of the second antenna element that is close to the angle (θ), for connecting the feed conductor to the antenna elements.

27. The portable communication device according to claim 26, where the feed point comprises a matching network for maximizing a power transfer from the feed conductor to the antenna elements.

28. The portable communication device according to claim 27, where the matching network comprises a PI-shaped network that includes a first component (Z1), a second component (Z2), and a third component (Z3).

29. The portable communication device according to claim 28, where:

the first component (Z1) connects between a feed line and the conductor plate;

the second component (Z2) connects between the feed line and the signal ground; and the third component (Z3) connects between the conductor plate and the signal ground.

30. The portable communication device according to claim 29, where:

the first component (Z1) comprises a capacitance of approximately five picofarad;

the second component (Z2) comprises a capacitance of approximately one picofarad; and the third component (Z3) comprises an inductance of approximately nine nanohenry.

* * * * *